US006780455B2

(12) United States Patent
Clarke et al.

(10) Patent No.: US 6,780,455 B2
(45) Date of Patent: Aug. 24, 2004

(54) METHOD OF CREATING AND COATING A MATERIAL

(75) Inventors: Andrew Clarke, Berkhampstead (GB); Christopher L. Bower, Headington (GB); Kim E. Goppert, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 28 days.

(21) Appl. No.: 10/178,724

(22) Filed: Jun. 24, 2002

(65) Prior Publication Data

US 2003/0064162 A1 Apr. 3, 2003

(30) Foreign Application Priority Data

Jul. 7, 2001 (GB) ..... 0116683

(51) Int. Cl.[7] ..... B05D 1/30
(52) U.S. Cl. ..... 427/8; 427/420
(58) Field of Search ..... 427/8, 420; 264/284

(56) References Cited

U.S. PATENT DOCUMENTS 3,508,947 A 4/1970 Highes
3,632,374 A 1/1972 Greiller
6,099,913 A * 8/2000 Clarke et al. ..... 427/420
6,103,313 A * 8/2000 Clarke et al. ..... 427/420

FOREIGN PATENT DOCUMENTS

EP 996 033 A1 * 4/2000
EP 9960034 A1 * 4/2000

* cited by examiner

*Primary Examiner*—Katherine A. Bareford
(74) *Attorney, Agent, or Firm*—Miton S. Sales; Mark G. Bocchetti

(57) ABSTRACT

The invention provides a method of creating a material for use as a material to be coated by curtain coating, comprising the step of: creating a surface texture of said material such that when said material is coated with a freely falling curtain formed of a composite layer of one or more coating compositions that impinges at a point of impingement against a continuously moving receiving surface of said material using roughness assisted wetting, the height of the composite layer at a distance λ from the point of impingement, in which λ is the average periodicity of the surface texture, is less than or equal to $R_z$. The invention also provides a method of identifying a material suitable for coating with Roughness Assisted coating.

18 Claims, 2 Drawing Sheets

METHOD OF CREATING AND COATING A MATERIAL

FIELD OF THE INVENTION

The present invention relates to a method of creating a material suitable for use in curtain coating. The invention also relates to a method by which one or more viscous liquid compositions may be coated on to a material such as a continuously moving web of material, as in the manufacture of photographic material such as films, photographic papers, magnetic recording tapes, adhesive tapes, etc.

BACKGROUND OF THE INVENTION

Curtain coating is a method of coating used extensively in the manufacture of photographic material and products as described in U.S. Pat. Nos. 3,508,947 and 3,632,374. In this method a free-falling liquid curtain of a coating composition is allowed to impinge against a continuously moving web of material. U.S. Pat. Nos. 3,508,947 and 3,632,374 disclose systems in which curtain coating of aqueous gelatin solutions is used.

It is known that wetting in a coating process operates in one of at least two regimes. These are: normal wetting where the coating liquid wets the entire surface of the material being coated, and wetting where a thin film of air is entrained, but is disrupted by the surface topography of the material and subsequently dissolves. U.S. Pat. Nos. 6,099,913 and 6,103,313 are examples of systems in which the synergistic application of a coating composition having a high viscosity and a web to be coated with a specified degree of roughness enable high coating speeds to be achieved, i.e., Roughness Assisted (RA) wetting.

On a rough support, although air-entrainment occurs at approximately the same speed as on a smooth support, provided the coating and material parameters are in the correct range, then coating proceeds until a higher speed, at which point a sudden and gross failure occurs.

It is possible at present to estimate, for a given coating parameter set, that RA wetting is possible, and in addition that if RA wetting is operating, at which higher speed gross failure is expected. Currently available systems only take account of the average peak-to-peak height $R_z$ of the surface of a substrate.

The parameter $R_z$ is a ten point average peak-to-peak roughness measure as shown in FIG. 1 (DIN4768). A sample of the surface of the material is defined and the surface topography determined. The sample is then split up into 5 components of length $I_m$ and an average peak-to-peak distance is calculated. $R_z$ is calculated as $$\frac{1}{5}\sum_{i=1\text{to}5} R_{zi}$$

in which $R_{zi}$ is the peak-to-peak distance in the ith component.

Whilst it is clear that a constraint on this parameter is a necessary condition further specification is desired Considering a surface composed of beads of a common size, any density of beads up to a limit (defined by the length $I_m$ in FIG. 1) will give the same value for $R_z$, whereas for each density of beads there is a further characterising roughness of the material which is unaccounted for in known systems. In other words, as the beads are spaced further apart, although $R_z$ will remain constant until a spacing determined by $I_m$ is reached, the surface topography changes. The propensity for RA wetting will fall, since as the spacing increases the surface will tend to behave more like a smooth surface with isolated perturbations.

Problem to be Solved by the Invention

A method of creating a material is desired on which it is known that RA wetting can occur. A method is required that enables determination of whether or not a particular material is suitable for RA wetting. In particular, a method is required of determining the suitability of a substrate for RA wetting relative to the surface topography.

The method is required for use in the creation of substrates suitable for use in the manufacture of, amongst others, photographic material such as films and photographic paper, magnetic recording tapes, adhesive tapes, inkjet receiver materials etc.

A method is required that enables, for a given set of coating conditions and coating compositions, determination of whether or not the surface to be coated is capable of RA wetting. In addition a method is also required that enables identification of which mechanism of coating, normal wetting or RA wetting, is operating. This enables the appropriate application of a model to predict air-entrainment or gross failure speed in curtain coating.

SUMMARY OF THE INVENTION

According to a first aspect of the present invention, there is provided a method of creating a material for use as a material to be coated by curtain coating, comprising the step of creating a surface texture of the material such that when the material is coated with a freely falling curtain formed of a composite layer of one or more coating compositions that impinges at a point of impingement against a continuously moving receiving surface of the material having a roughness $R_z$ (DIN4768) in which the coating composition forming the layer adjacent to the receiving surface has a viscosity, $\eta$, measured at a shear rate of 10,000 $s^{-1}$ such that when combined with the roughness $R_z$, the curtain gives a value of a specifying parameter $\phi_{\square}$ that is greater than 1.

The specifying parameter $\phi_0$ is defined by $$\phi_0 = 1818\sigma^{1/3} R_z\left\{\frac{1}{0.0002}\eta U\cos\theta\left(1+\Omega\frac{\rho Q}{20\eta}\right)\right\};$$

in which

- $\sigma$ is the surface tension ($Nm^{-1}$) of the layer adjacent to the receiving surface;
- $\eta$ is the viscosity (Pas) measured at a shear rate of 10000 $s^{-1}$ of the layer adjacent to the receiving surface;
- $\theta$ is the angle formed between the curtain and a normal to the receiving surface at the point of impingement;
- $\rho$ is the average density ($Kg/m^3$) of the one or more coating compositions;
- Q is the total volumetric flow rate per unit width ($m^2/s$) of the curtain;
- $\Omega$ is a Lorentzian factor which reduces the influence of momentum when flow rate is high or viscosity is low, the height of the composite layer at a distance $\lambda$ from the point of impingement, in which $\lambda$ is the average periodicity of the surface texture, is less than or equal to $R_z$.

Preferably, the condition $$\frac{R_z}{\lambda^2} > \frac{\rho g H}{4\gamma} \text{ is satisfied,}$$

wherein:

$\rho$ is the average coating composition density;

$\gamma$ is the surface tension of the layer adjacent to said receiving surface; and H is the curtain height.

In one example, the surface texture of the material is intrinsic to a substrate of the material. Alternatively, the texture of the material is created by embossing a surface thereof or the roughness of the material is created by the inclusion of dispersed particulates in a subbing formulation.

Preferably, the step of creating a surface texture of the material is performed such that a parameter $\phi_\in$ is defined by $$\phi_\in = \phi_0 + 1818\sigma^{1/3} R_z \{\tfrac{1}{2} \in \in_0 E^2\}$$

in which $\phi_0$ is the specifying parameter defined according to the first aspect of the present invention;

$\in_0$ is the permittivity of free space;

$\in$ is the dielectric constant of an ambient gas, and

E is the field strength (V/m) of an electrostatic field provided at the surface of the composite layer of one or more coating compositions at the point of impingement, preferably, between 3 and 30 kV/mm.

Preferably, the Lorentzian factor $\Omega$ is defined by;

$$\Omega = \frac{25}{25 + \left(\frac{\rho Q}{\eta} - 8\right)^2}.$$

The electrostatic field may be provided by a voltage of between 200V and 2000V (preferably between 600V and 1500V) between the one or more coating compositions and a backing surface of the receiving surface. In one example, the electrostatic field is generated by charges on the receiving surface.

The receiving surface is preferably a web made of a material selected from the group consisting of paper, plastic films, resin-coated paper, clay-coated paper, calendered paper, synthetic paper, plastic films overcoated with a subbing layer containing surfactant. If the material is a photographic material, the one or more coating compositions may comprise photographic emulsions, protective layers, filter layers or the like.

According to a second aspect of the present invention, there is provided a method of curtain coating a material, comprising the step of forming a freely falling curtain of a composite layer arranged to impinge against a continuously moving receiving surface of the material in which the material is created according to the method of the first aspect of the present invention.

Preferably, the roughness $R_z$ of the material is greater than 2 $\mu$m and/or less than 20 $\mu$m. More preferably, the roughness $R_z$ is greater than 4 $\mu$m and less than 10 $\mu$m. It is preferred that the viscosity of the coating material forming the wetting layer has, measured at a shear rate of 10,000 $s^{-1}$, is between 10 mPas and 270 mPas.

In one example of the present invention, an electrostatic field is used to improve traction between the one or more coating compositions and the material being coated. In this case, the coating composition forming the layer adjacent to the receiving surface of the material has a viscosity, $\eta$, measured at a shear rate of 10,000 $s^{-1}$ such that when combined with said roughness $R_z$, the curtain gives a value of a specifying parameter $\phi_\in$ that is greater than 1.

The specifying parameter $\phi_\in$ is defined by $$\phi_\in = \phi_0 + 1818\sigma^{1/3} R_z \{\tfrac{1}{2} \in \in_0 E^2\}$$

in which:

$\phi_0$ is the specifying parameter defined in accordance with the first aspect of the present invention;

$\in_0$ is the permittivity of free space;

$\in$ is the dielectric constant of an ambient gas; and

E is the field strength (V/m) of an electrostatic field provided at the surface of the composite layer of one or more coating compositions at the point of impingement.

According to a third aspect of the present invention, there is provided a method for curtain coating, comprising the step of forming a composite layer of one or more coating compositions. A freely falling curtain is formed from the composite layer and impinged (at a point of impingement) against a continuously moving receiving surface to be coated having a roughness $R_z$ (DIN4768).

The coating composition forming the layer adjacent to the receiving surface, is provided with a viscosity, $\eta$, measured at a shear rate of 10,000 $s^{-1}$ such that when combined with said roughness $R_z$, the curtain gives a value of a specifying parameter $\phi_0$ that is greater than 1.

The specifying parameter $\phi_0$ is defined by $$\phi_0 = 1818\sigma^{1/3} R_z \left\{\frac{1}{0.0002}\eta U \cos\theta \left(1 + \Omega \frac{\rho Q}{20\eta}\right)\right\};$$

in which:

$\sigma$ is the surface tension ($Nm^{-1}$) of the layer adjacent to the receiving surface;

$\eta$ is the viscosity (Pas) measured at a shear rate of 10000 $s^{-1}$ of the layer adjacent to the receiving surface;

$\theta$ is the angle formed between the curtain and a normal to the receiving surface at the point of impingement;

$\rho$ is the average density ($Kg/m^3$) of the one or more coating compositions;

Q is the total volumetric flow rate per unit width ($m^2/s$) of the curtain;

$\Omega$ is a Lorentzian factor which reduces the influence of momentum when flow rate is high or viscosity is low; and a height function h(x) defines the variation of the height of the composite layer with distance x from the point of impingement, such that $h(x) \leqq R_z$ at $x=\lambda$ in which $\lambda$ is the average periodicity of the roughness of the receiving surface According to a fourth aspect of the present invention, there is provided a method of identifying a material suitable for use in curtain coating using roughness assisted wetting, comprising the step of modelling a height function h(x) of the variation of the height of a composite layer (to be coated onto a material) with distance x from the impingement point of the composite layer on the material, the material being identified as suitable for the coating only if, $h(x) \leqq R_z$ at $x=\lambda$ in which $\lambda$ is the average periodicity of the roughness of a receiving surface of the material. $R_z$ (DIN4768) is the roughness of the material.

The height function h(x) is modelled from a freely falling curtain of a composite layer that impinges at an impingement point against a continuously moving receiving surface of a material having a roughness $R_z$ (DIN4768) in which the coating composition forming the layer adjacent to said receiving surface has a viscosity, $\eta$, measured at a shear rate of 10,000 $s^{-1}$ such that when combined with said roughness $R_z$, the curtain gives a value of a specifying parameter $\phi_0$ that is greater than 1.

The specifying parameter $\phi_0$ is defined by $$\phi_0 = 1818\sigma^{1/3}R_z\left\{\frac{1}{0.0002}\eta U\cos\theta\left(1+\Omega\frac{\rho Q}{20\eta}\right)\right\};$$

in which:

$\sigma$ is the surface tension ($Nm^{-1}$) of the liquid layer adjacent to the receiving surface;

$\eta$ is the viscosity (Pas) measured at a shear rate of 10000 $s^{-1}$ of the composition adjacent to the receiving surface;

$\theta$ is the angle formed between the curtain and a normal to the receiving surface at the point of impingement;

$\rho$ is the average density ($Kg/m^3$) of the one or more coating compositions;

Q is the total volumetric flow rate per unit width ($m^2/s$) of the curtain; and $\Omega$ is a Lorentzian factor which reduces the influence of momentum when flow rate is high or viscosity is low.

According to a further aspect of the present invention, there is provided a method of creating a material for use as a material to be coated by curtain coating, comprising the step of creating a surface texture of the material such that when the material is coated with a freely falling curtain formed of a composite layer of one or more coating compositions that impinges at a point of impingement against a continuously moving receiving surface of the material using roughness assisted wetting, the height of the composite layer at a distance $\lambda$ from the point of impingement, in which $\lambda$ is the average periodicity of the surface texture, is less than or equal to $R_z$.

Advantageous Effect of the Invention

The present invention provides a method of creating a material having a surface topography suited for RA wetting during curtain coating. Therefore, if the coating parameters are known the invention enables accurate determination of whether or not any particular material is suitable for RA wetting. The method is accurate since the determination of suitability for RA wetting is in dependence on surface topography, which can be measured accurately.

The method enables materials to be created particularly suitable for use in the manufacture of, amongst others, photographic material such as films and photographic paper, magnetic recording tapes, adhesive tapes, etc. In the manufacture of photographic material, a substrate material may be coated with gelatine based compositions. High coating speed is desirable since this reduces the cost per unit length of material coated and the present invention therefore provides a method that enables the cost of manufacture of photographic material to be controlled.

BRIEF DESCRIPTION OF THE DRAWINGS

Examples of the present invention will now be described in detail with reference to the accompanying drawings, in which.

DETAILED DESCRIPTION OF THE INVENTION

Figure 1:
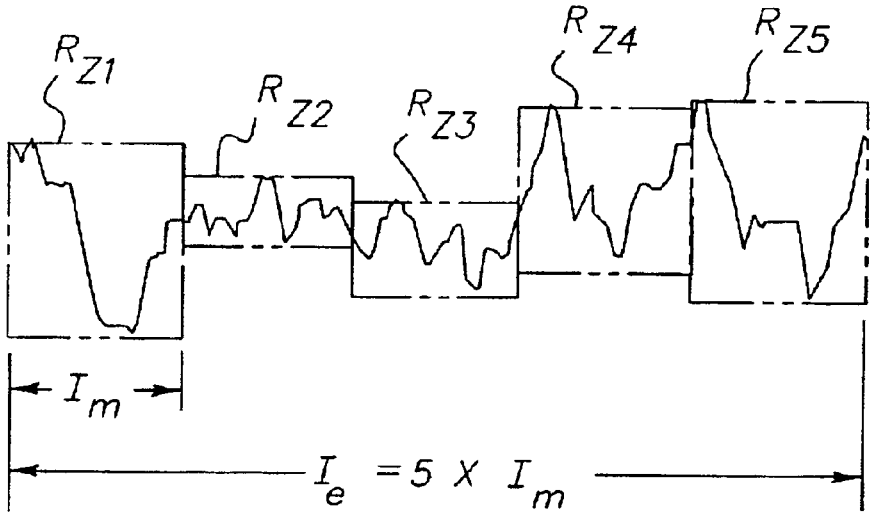
FIG. 1 is a diagram of a surface to define the parameter $R_z$ used in the method of the present invention.
Figure 2:
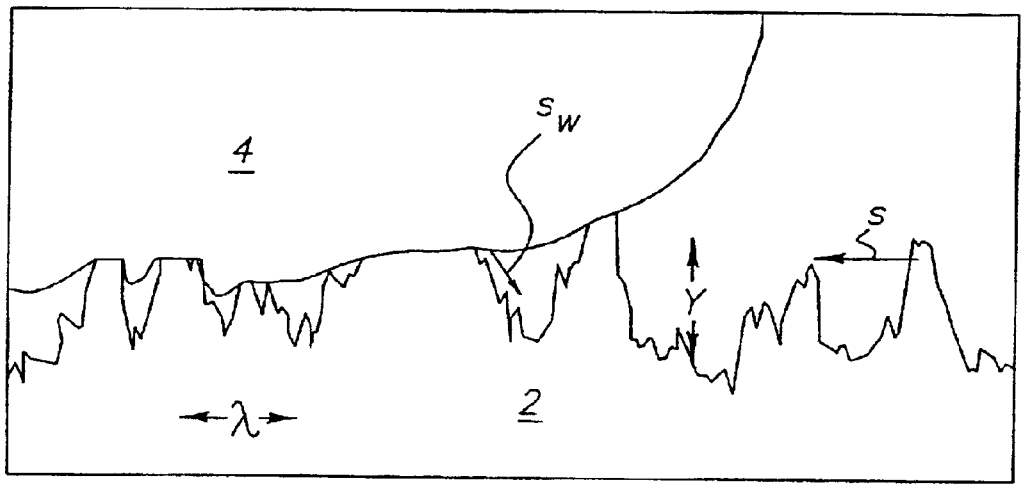
FIG. 2 is a schematic representation of a material being coated.

FIG. 2 is a schematic view of a material 2 being coated by a liquid composition 4, in which the material is moving at speed S. The maximum wetting speed for a liquid of the same chemistry as liquid composition 4 on a smooth but otherwise chemically identical surface is $S_w$. If the surface were smooth, then provided $S<S_w$ coating proceeds without air-entrainment or gross failure. The surface is however rough and after the liquid wets a peak, it attempts to run down and wet the following valley. The maximum speed at which it can do this is $S_w$, and provided no large peak arrives before the valley is wetted then the complete surface is wetted as for a smooth substrate. Conversely, if a peak arrives and touches the liquid surface before the liquid can wet the valley, an air pocket is trapped and wetting continues over the newly wetted peak.

If we describe the substrate by a height function y(x) with average periodicity $\lambda$, then the time to wet length $\lambda$ is:

$$t_w = \frac{1}{S_w}\int_0^{\lambda}\left(\left(\frac{dy}{dx}\right)^2+1\right)^{1/2}dx$$

whereas the time to cover the same distance without completely wetting the valleys is:

$$t_s = \frac{\lambda}{S}$$

If it is assumed that the average peak-to-valley height is Rz and that the surface can be approximated by triangles, then by taking the ratio of these two times, $$T = \frac{t_w}{t_s} = \frac{S}{S_w}\left(1+4\frac{R_z^2}{\lambda^2}\right)^{1/2}$$

If T>1, then the time to wet the valley is greater than the time to skip to the next peak and so either RA wetting or gross failure is expected. Hence, the condition $$S > S_W^R = S_w\left(1+4\frac{R_Z^2}{\lambda^2}\right)^{-1/2}$$

implies that RA wetting or gross failure is occurring.

If T<1 then the substrate is moving sufficiently slowly that complete wetting will occur. If the height of the roughness, Rz, goes to zero then skipping will occur at $S=S_w$, i.e. the air-entrainment speed, whereas if $Rz>\lambda$, skipping will occur well before $S=S_w$.

The above discussion gives an argument for the speed at which skipping will start relative to the normal wetting speed, but does not allow any prediction of which surface topography will enable skipping, and hence RA wetting, and which will not.

Figure 3:
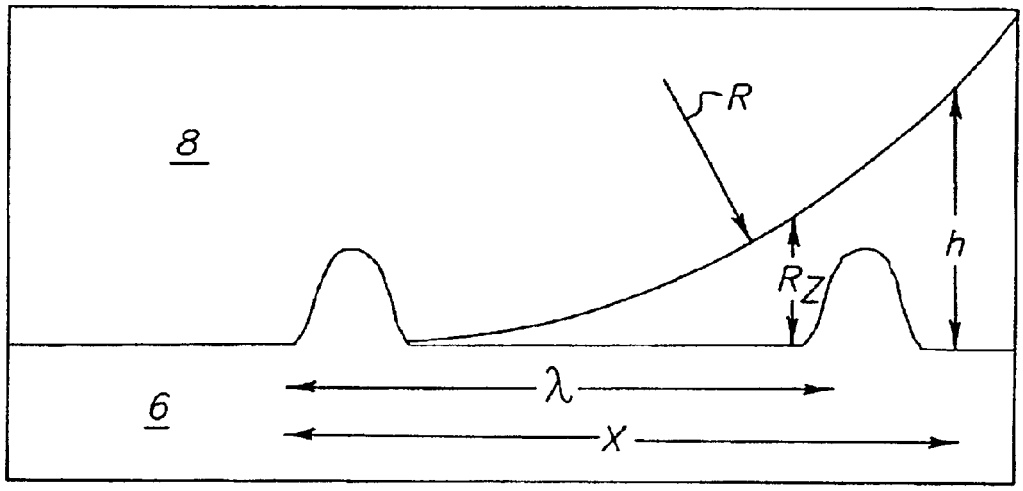
FIG. 3 is a schematic representation of a material being coated in accordance with the method of the present invention.

FIG. 3 is a schematic view of a material 6 being coated in accordance with the method of the present invention by a liquid composition 8. The liquid composition 8 may be a composite layer of one or more coating compositions. For example, the liquid composition 8 may be made up of a number of layers of different or identical coating composition. The radius of curvature R of the leading liquid surface, is given by Laplace as $\gamma/\Delta P$, where $\gamma$ is the liquid surface tension and $\Delta P$ is the pressure difference across the interface and is dependent on, amongst other factors, the speed at which the material moves. Furthermore the height the liquid rises above the solid surface, h(x), is given in this case approximately by $x^2/2$ R, in which x is a distance along the solid surface from the point of impingement, normal to the wetting line.

For RA wetting, the liquid must intersect asperities on the surface of the material 6 so that the condition Rz>h(x) at x=$\lambda$ is satisfied. Therefore, $$h = \frac{x^2}{2R} = x^2 \frac{\Delta P}{2\gamma}$$

and thus $$\frac{Rz}{\lambda^2} > \frac{\Delta P}{2\gamma}$$

A new parameter $\Lambda$ may be identified as $$\Lambda = \frac{Rz}{\lambda^2},$$

which defines a critical roughness.

The example shown in FIG. 3 is a simplified schematic representation of a rough surface. If the surface is randomly rough, rather than comprised of the simple asperities illustrated in FIG. 3, then a statistical description of the mean surface height change for a given distance along the surface is required. In this case, the appropriate function is the change of height correlation function C(x), $$C(x) \equiv \langle [h(x+x_0)-h(x)] \rangle \equiv \langle [h(x)]^2 \rangle$$

which goes to $\sigma^2$, the variance of the surface height, when the heights h(x) and $h(x_0)$ become uncorrelated at a distance much greater than the correlation length, $\xi$. C(x) can be calculated as $$C(x) = \sigma^2 \left\{ 1 - \exp\left[ -\left( \frac{x}{\xi} \right)^{2\alpha} \right] \right\}$$

where $\sigma$ is the standard deviation of h(x), $\xi$ is the correlation length as before, and $\alpha$ is the roughness exponent. The square root of C(x) is the rms value of $\Delta h$, hence $$\frac{\sqrt{\langle \Delta h(x) \rangle}}{x^2} = \frac{\sigma \left\{ 1 - \exp\left[ -\left( \frac{x}{\xi} \right)^{2\alpha} \right] \right\}^{1/2}}{x^2} > \frac{\Delta P}{2\gamma}$$

where only the maximum value of the LHS of the inequality need be considered, thus $$\left. \frac{\sqrt{\langle \Delta h(x) \rangle}}{x^2} \right|_{\max} \approx \frac{3\sigma}{5\xi^2} > \frac{\Delta P}{2\gamma}, \text{ (for } \alpha = 0.5)$$

For a randomly rough surface, typically $R_z \approx 6\sigma$ and $\lambda \approx 3\xi$. Therefore the above result corresponds well to the earlier result for a particulate-like surface, i.e.

$$\Lambda = \left[ \frac{Rz}{\lambda^2} \right] \quad \text{particulate surface}$$

$$\Lambda = \left[ \frac{3\sigma}{5\xi^2} \right] \approx \left[ \frac{Rz}{\lambda^2} \right] \quad \text{random surface}$$

To make an order of magnitude estimate we can take $\Delta P = 0.25\ \rho U^2 = 0.5\ \rho g H$ as described in Blake, Clarke and Ruschak, AIChE Journal 40 2 (1994) 229, with H the curtain height. Therefore, for H=25 cm, $\gamma$=30 $mNm^{-1}$ and $\rho$=1 $gcm^{-3}$ $$\Lambda > \frac{\rho g H}{4\gamma} \approx 0.02\ (\mu m^{-1})$$

Although this is a rough estimate, it implies that the critical roughness, $\Lambda$, depends on the load pressure, $\Delta P$, and is thus proportional to curtain height H.

Various webs can be employed as the material to be coated in the application of the present invention and include, but are not limited to, paper, plastic films, resin-coated paper, pre-coated paper and synthetic paper. Plastic films may be made of polyolefins such as polyethylene and polypropylene, vinyl polymers such as polyvinyl acetate, polyvinyl chloride and polystyrene, polyamides such as 6,6-nylon and 6-nylon, polyesters such as polyethylene terephthalate and polyethylene-2,6-naphthalate, polycarbonates and cellulose acetates such as cellulose monoacetate, cellulose diacetate and cellulose triacetate.

Resins used to make resin-coated paper are exemplified by but not limited to polyolefins such as polyethylene. Materials used to pre-coat papers are exemplified by but not limited to clay-based slurries, other particulate dispersions or emulsions. Additionally, the web may have subbing layers containing surfactants for the purpose of enhancing wetting, adhesion or other purposes. The web may also contain one or more electrically conductive layers.

The web used preferably has a surface roughness, $R_z$, of at least 2 $\mu$m, but preferably not more than about 20 $\mu$m. Examples of such webs are those used in the manufacture of photographic papers or inkjet receiver papers which have a glossy surface, matte surface or lustre surface, etc. These papers are commonly manufactured from raw paper stock onto which is laminated one or more polyethylene layers which may be compressed with a textured roller to emboss the surface with the desired roughness. Alternatively, webs with such roughnesses may be obtained by pre-coating a composition of solid particles (i.e. particulates) or the like dispersed in a liquid or a composition of a polymeric emulsion onto one of the webs described above and subsequently drying the web. Examples of the particles include, amongst other suitable materials, polymethyl methacrylate, glass, latex and clay. Alternatively, webs with such roughnesses may be obtained by embossing or finely abrading one of the webs described above, or by any other method that leads to a surface topography having the appropriate roughness.

Figure 4:
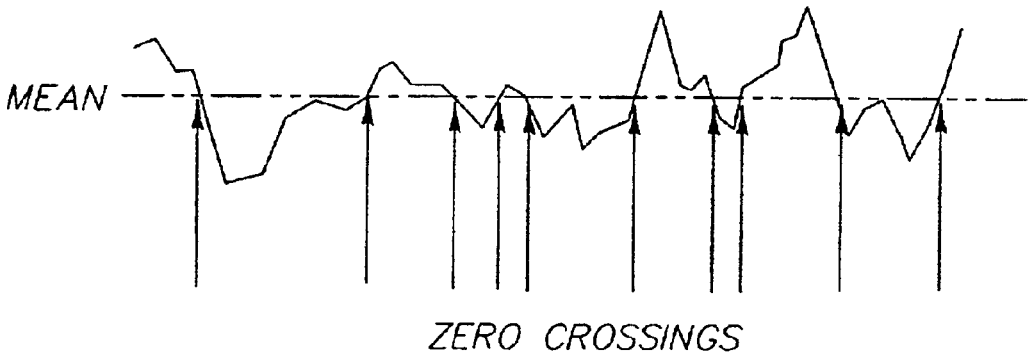
FIG. 4 is a schematic representation of a material demonstrating how surface periodicity is determined.

A method used to analyse rough surfaces for texture is to count the number of zero-crossings per unit length that occur for a trace across the sample i.e. the number of times the surface height crosses the mean height. This is illustrated schematically in FIG. 4. If the number of crossings per mm is N, then $\lambda$ ($\mu$m) is simply $$\lambda = 2.\frac{1000}{N}$$

with the factor of 2 to account for the fact that there are two crossings per period.

This method correctly identifies the mean periodicity of the surface provided individual peaks are not too widely spaced. For large spacings, the mean level will be close to the background level and therefore crossings due to noise between the peaks may be counted. The roughness of the web may be measured using a WYKO NT2000, WYKO corporation, and the viscosity of the coating compositions may be measured using a Bohlin CS rheometer. Other suitable methods and instruments may also be used for measuring these parameters. Surface tension may be measured by standard techniques as described in, for example, U.S. Pat. No. 5,824,887.

In one example of the present invention, an electrostatic field is used to improve traction between the one or more coating compositions and the material being coated. One preferred method for generating the required electrostatic field, involves the application of a voltage between a coating roller used to direct the material being coated and the coating composition. The field strength is calculated using standard methods of electrostatics as described in, for example, U.S. Pat. No. 6,103,313.

What is claimed is:

1. A method of creating a material for use as a material to be coated by curtain coating and curtain coating the material comprising the step of:

forming a freely falling curtain of a composite layer arranged to impinge against a continuously moving receiving surface of said material;

creating a surface texture of said material such that $h(\lambda) \leqq R_z$, $h(\lambda)$ being the height of the composite layer as a distance $\lambda$ from the point of impingement, in which $\lambda$ is the average periodicity of the surface texture and $R_z$ (DIN4768) being the roughness of the material;

and the material is coated with a freely falling curtain formed of a composite layer of one or more coating compositions that impinges at a point of impingement against a continuously moving receiving surface of said material having a roughness $R_z$ (DIN4768) as stated above in which the coating composition forming the layer adjacent to said receiving surface has a viscosity, $\eta$, measured at a shear rate of 10,000 $s^{-1}$ such that when combined with said roughness $R_z$, said curtain gives a value of a specifying parameter $\phi_0$ that is greater than 1, where said specifying parameter $\phi_0$ is defined by $$\phi_0 = 1818\sigma^{1/3}R_z\left\{\frac{1}{0.0002}\eta U\cos\theta\left(1+\Omega\frac{\rho Q}{20\eta}\right)\right\};$$

in which $\sigma$ is the surface tension ($Nm^{-1}$) of the layer adjacent to said receiving surface;

$\eta$ is the viscosity (Pas) measured at a shear rate of 10000 $s^{-1}$ of the layer adjacent to said receiving surface;

$\theta$ is the angle formed between said curtain and a normal to said receiving surface at the point of impingement;

$\rho$ is the average density ($Kg/m^3$) of said one or more coating compositions;

Q is the total volumetric flow rate per unit width ($m^2/s$) of said curtain; and $\Omega$ is a Lorentzian factor which reduces the influence of momentum when flow rate is high or viscosity is low, $\Omega$ being defined by $$\Omega = \frac{25}{25+\left(\frac{\rho Q}{\eta}-8\right)^2}.$$

2. A method according to claim 1, in which the surface texture of the material is intrinsic to a substrate of said material.

3. A method according to claim 1, in which the condition $$\frac{R_z}{\lambda^2} > \frac{\rho g H}{4\gamma} \text{ is satisfied,}$$

wherein g is acceleration due to gravity;

$\rho$ is the average coating composition density;

$\gamma$ is the surface tension of the layer adjacent to said receiving surface; and, H is the curtain height.

4. A method according to claim 1, in which the texture of the material is created by embossing a surface thereof.

5. A method according to claim 4, in which the material is polymer-coated paper.

6. A method according to claim 1, in which the roughness of the material is created by the inclusion of dispersed particulates in a pre-coated layer.

7. A method according to claim 1, in which the step of creating a surface texture of the material is performed such that a specifying parameter $\phi_\in$ is greater than 1, the parameter being defined by $$\phi_\in = \phi_0 + 1818\sigma^{1/3}R_z\{\tfrac{1}{2}\in\in_0 E^2\}$$

in which $\phi_0$ is the specifying parameter;

$\in_0$ is the permittivity of free space;

$\in$ is the dielectric constant of an ambient gas; and,

E is the field strength (V/m) of an electrostatic field provided at the surface of said composite layer of one or more coating compositions at the point of impingement.

8. A method according to claim 7, in which the electrostatic field strength is between 3 and 30 kV/mm.

9. A method according to claim 7, in which the electrostatic field is provided by a voltage of between 200V and 2000V between the one or more coating compositions and a backing surface of said receiving surface.

10. A method according to claim 7, in which the electrostatic field is provided by a voltage of between 600V and 1500V between the one or more coating compositions and a backing surface of said receiving surface.

11. A method according to claim 7, wherein the electrostatic field is generated by charges on the receiving surface.

12. A method according to claim 1, wherein the receiving surface is a web made of a material selected from the group consisting of paper, plastic films, resin-coated paper, clay-coated paper, calendered paper, synthetic paper, plastic films overcoated with a subbing layer containing surfactant.

13. A method according claim 1, wherein said one or more coating compositions comprise photographic emulsions, protective layers, or filter layers.

14. A method according to claim 1, in which the roughness $R_z$ is greater than 2 $\mu$m.

15. A method according to claim 14, in which the roughness $R_z$ is less than 20 $\mu$m.

16. A method according to claim 1, wherein the roughness Rz is greater than 4 $\mu$m and less than 10 $\mu$m.

17. A method according to claim 1, wherein the viscosity of the coating material forming the wetting layer has a viscosity measured at a shear rate of 10,000 $s^{-1}$ of between 10 mPas and 270 mPas.

18. A method of creating a material for use as a material to be coated by curtain coating and curtain coating the material comprising the step of:

forming a freely falling curtain of a composite layer arranged to impinge against a continuously moving receiving surface of said material;

creating a surface texture of said material such that when said material is coated with the freely falling curtain formed of a composite layer of one or more coating compositions that impinges at the point of impingement against a continuously moving receiving surface of said material using roughness assisted wetting, the height of the composite layer at a distance $\lambda$ from the point of impingement, in which $\lambda$ is the average periodicity of the surface texture, is less than or equal to $R_z$ (DIN4768).

* * * * *